US009462848B2

(12) United States Patent
Cavaliere et al.

(10) Patent No.: US 9,462,848 B2
(45) Date of Patent: Oct. 11, 2016

(54) ARTICLE OF FOOTWEAR HAVING A SOLE STRUCTURE

(71) Applicant: Nike, Inc., Beaverton, OR (US)

(72) Inventors: Sergio Cavaliere, Venice (IT); Giovanni Adami, Montebelluna (IT); Timothy J. Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 141 days.

(21) Appl. No.: 14/049,779

(22) Filed: Oct. 9, 2013

(65) Prior Publication Data

US 2015/0096198 A1 Apr. 9, 2015

(51) Int. Cl.

| | |
|---|---|
| ***A43B 13/22*** | (2006.01) |
| ***A43B 5/00*** | (2006.01) |
| ***A43B 5/02*** | (2006.01) |
| ***A43B 9/12*** | (2006.01) |
| ***A43B 13/12*** | (2006.01) |
| ***A43B 13/14*** | (2006.01) |
| ***A43B 13/26*** | (2006.01) |

(52) U.S. Cl.

CPC ..... *A43B 13/22* (2013.01); *A43B 5/00* (2013.01); *A43B 5/02* (2013.01); *A43B 9/12* (2013.01); *A43B 13/12* (2013.01); *A43B 13/14* (2013.01); *A43B 13/26* (2013.01)

(58) Field of Classification Search

CPC ..... A43B 9/12; A43B 5/00; A43B 5/02; A43B 13/12; A43B 13/122; A43B 13/125; A43B 13/127; A43B 13/22; A43B 13/26; A43B 13/14; A43B 12/21

USPC ..... 36/103, 17 R

See application file for complete search history.

(56) References Cited

U.S. PATENT DOCUMENTS

| | | | |
|---|---|---|---|
| 1,735,986 | A | 11/1929 | Wray |
| 2,005,048 | A | 6/1935 | Randall |
| 2,398,044 | A | 4/1946 | Sbarra |

(Continued)

FOREIGN PATENT DOCUMENTS

| | | | |
|---|---|---|---|
| DE | 3245182 | A1 | 12/1982 |
| DE | 19708113 | A1 | 9/1998 |

(Continued)

OTHER PUBLICATIONS

International Search Report and Written Opinion for Application No. PCT/US2014/053815, mailed Dec. 8, 2014.

(Continued)

*Primary Examiner* — Shaun R Hurley
*Assistant Examiner* — Bao-Thieu L Nguyen
(74) *Attorney, Agent, or Firm* — Plumsea Law Group, LLC

(57) ABSTRACT

An article of footwear having a sole structure and an upper secured to the sole structure and configured to receive a foot. The sole structure includes a lasting board and sole plate construction. One of the lasting board and sole plate may have an opening along the center such that there is little to no overlap, or lamination, between the lasting board and the sole plate along the center of the article of footwear. Such a construction may eliminate weight while maintaining the support provided by the layers of the sole. Additionally, such a construction may enhance flexibility. In some embodiments, the article of footwear may include an insole. In some embodiments, the sole structure of the article of footwear may consist of an insole, a lasting board, and a sole plate.

20 Claims, 12 Drawing Sheets

(56) References Cited

U.S. PATENT DOCUMENTS

| | | | | |
|---|---|---|---|---|
| 2,799,034 | A | 7/1957 | Crowell | |
| 3,696,455 | A * | 10/1972 | Batchelder et al. | 12/145 |
| 4,794,707 | A | 1/1989 | Franklin et al. | |
| 5,896,608 | A | 4/1999 | Whatley | |
| 6,176,025 | B1 | 1/2001 | Patterson et al. | |
| 6,519,874 | B1 | 2/2003 | Dean | |
| 6,708,427 | B2 | 3/2004 | Sussmann et al. | |
| 6,973,746 | B2 | 12/2005 | Auger et al. | |
| 7,370,439 | B1 * | 5/2008 | Myers | 36/31 |
| 7,918,041 | B2 | 4/2011 | Cho | |
| 8,291,617 | B2 | 10/2012 | Halberstadt et al. | |
| 8,356,428 | B2 | 1/2013 | Auger et al. | |
| 2002/0050077 | A1 | 5/2002 | Wang et al. | |
| 2004/0032042 | A1 | 2/2004 | Chi | |
| 2004/0181970 | A1 | 9/2004 | Covatch | |
| 2004/0221485 | A1 | 11/2004 | Pfander | |
| 2004/0237341 | A1 * | 12/2004 | Issler | 36/25 R |
| 2005/0016029 | A1 | 1/2005 | Auger et al. | |
| 2007/0074421 | A1 * | 4/2007 | Wu | 36/17 R |
| 2008/0127516 | A1 | 6/2008 | Sessa et al. | |
| 2012/0023686 | A1 | 2/2012 | Huffa et al. | |
| 2012/0036740 | A1 | 2/2012 | Gerber | |
| 2012/0260526 | A1 | 10/2012 | Smith et al. | |
| 2013/0047472 | A1 | 2/2013 | Shih | |
| 2014/0283410 | A1 | 9/2014 | Marvin | |
| 2014/0290100 | A1 * | 10/2014 | Flowers | A43B 21/24 36/103 |

FOREIGN PATENT DOCUMENTS

| | | | |
|---|---|---|---|
| EP | 1716773 | A1 | 11/2006 |
| WO | 0178542 | A1 | 10/2001 |
| WO | 02087375 | A1 | 11/2002 |
| WO | 201057207 | A2 | 5/2010 |

OTHER PUBLICATIONS

International Search Report and Written Opinion for Application No. PCT/US2014/053811, mailed Dec. 12, 2014.

All About Shoe Making, http://howtoshoes.blogspot.nl/2012/09lcalifornia-and-dip-construction.html, accessed Nov. 28, 2014, 5pp.

Non-Final Office Action mailed Jun. 5, 2015 in U.S. Appl. No. 14/049,920.

Non-Final Office Action mailed Sep. 28, 2015 in pending U.S. Appl. No. 14/049,920.

Final Office Action dated Feb. 22, 2016 in U.S. Appl. No. 14/049,920.

International Preliminary Report on Patentability (including Written Opinion of the ISA) issued Apr. 12, 2016 in PCT Application No. PCT/US2014/053811.

International Preliminary Report on Patentability (including Written Opinion of the ISA) issued Apr. 12, 2016 in PCT Application No. PCT/US2014/053815.

* cited by examiner

ARTICLE OF FOOTWEAR HAVING A SOLE STRUCTURE

BACKGROUND

The present invention relates generally to a construction for an article of footwear and, more particularly, to construction for sole structure of an article of footwear.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction, for example. Accordingly, the upper and the sole structure operate cooperatively to provide a comfortable structure that is suited for a wide variety of athletic activities.

The sole structure is often made from multiple laminated layers of material. At times, the laminated layers of material interfere with the flexibility of an article of footwear. Additionally, the weight of each layer of the sole structure contributes to the weight of the article of footwear. It would be advantageous to be able to increase the flexibility and reduce the weight of a sole structure while maintaining the benefits of the sole structure mentioned above.

SUMMARY

In one aspect, the present disclosure is directed to an article of footwear including a lasting board that may have a ground side surface and a foot side surface opposite the ground side surface. The ground side surface of the lasting board may have a peripheral area extending along a peripheral edge of the lasting board. The ground side surface of the lasting board may have a central area disposed inside of the peripheral area. The article of footwear may include an upper secured to the peripheral area of the ground side surface of the lasting board. The article of footwear may include a sole plate having a ground side surface and a foot side surface opposite the ground side surface. The foot side surface of the sole plate may be secured to the upper. The sole plate may overlie the peripheral area of the lasting board and may have an opening exposing the central area of the lasting board.

The central area of the ground side surface of the lasting board may be bounded by the peripheral area of the ground side surface of the lasting board.

The lasting board may be disposed between an insole and a lower portion of the upper.

A lower portion of the upper may be disposed between the lasting board and the sole plate.

The lasting board may extend continuously from a forward edge of the article of footwear to a rearward edge of the article of footwear and the lasting board may extend continuously from a medial edge of the article of footwear to a lateral edge of the article of footwear.

The opening in the sole plate may extend along a majority of the longitudinal axis of the article of footwear.

The opening in the sole plate may be defined by an inner peripheral edge of the sole plate that is substantially parallel to an outer peripheral edge of the sole plate.

In one aspect, the present disclosure is directed to an article of footwear that may include a lasting board having a ground side surface and a foot side surface opposite the ground side surface. The ground side surface of the lasting board may have a peripheral area extending along a peripheral edge of the lasting board. The ground side surface of the lasting board may have a central area disposed inside of the peripheral area. The article of footwear may have a sole plate having a ground side surface, a foot side surface opposite the ground side surface, an outer peripheral edge, and an inner peripheral edge defining an opening. The sole plate may overlie the lasting board and the opening may expose the central area of the lasting board. The article of footwear may include an upper having a lower portion disposed between the ground side surface of the lasting board and the foot side surface of the sole plate.

The foot side surface of the sole plate may be secured to the upper. A width of the sole plate may be defined between the inner peripheral edge and the outer peripheral edge and the width may be substantially constant along the entire sole plate.

The lasting board may extend continuously from a forward edge of the article of footwear to a rearward edge of the article of footwear and the lasting board may extend continuously from a medial edge of the article of footwear to a lateral edge of the article of footwear.

The opening in the sole plate may extend along a majority of the longitudinal axis of the article of footwear.

The inner peripheral edge of the sole plate may be substantially parallel to the outer peripheral edge of the sole plate.

A first cleat may extend from the lasting board.

A second cleat may extend from the sole plate.

The first cleat may extend from the central area of the lasting board and the first cleat may be exposed by the opening in the sole plate.

In one aspect, the present disclosure is directed to an article of footwear that may include a lasting board having a ground side surface and a foot side surface opposite the ground side surface. The ground side surface of the lasting board may have a peripheral area extending along a peripheral edge of the lasting board. The ground side surface of the lasting board may have a central area disposed inside of the peripheral area. The article of footwear may include an upper secured to the peripheral area of the ground side surface of the lasting board. The article of footwear may include a sole plate having a ground side surface and a foot side surface opposite the ground side surface. The sole plate may overlie the peripheral area of the lasting board and may have an opening exposing the central area of the lasting board such that the ground side surface of the sole plate and the central area of the ground side surface of the lasting board together form a ground-engaging surface of the article of footwear.

The peripheral area of the lasting board may be disposed between an insole and a lower portion of the upper.

The opening in the sole plate may extend along a majority of the longitudinal axis of the article of footwear.

A first cleat may extend from the lasting board.

A second cleat may extend from the sole plate.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
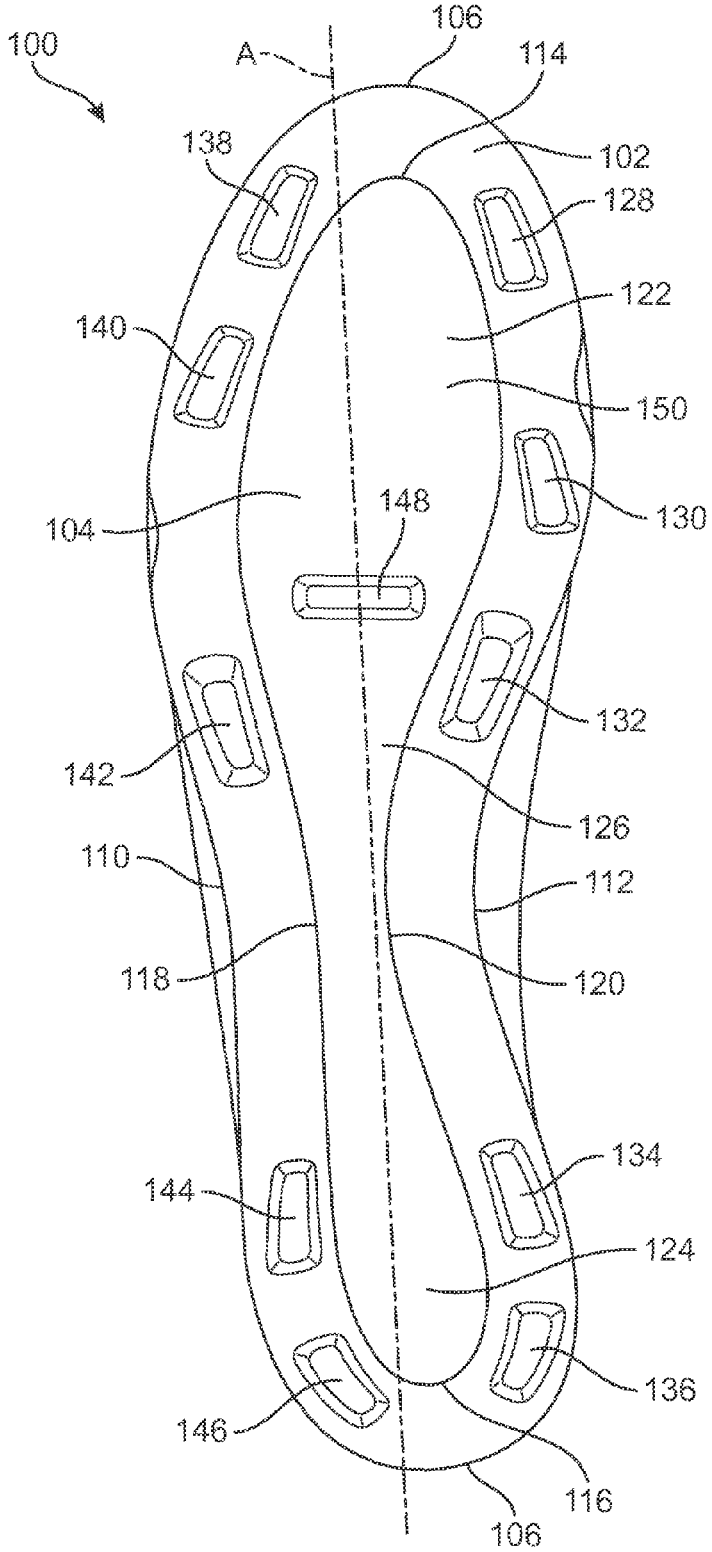
FIG. 1 shows an embodiment of an article of footwear having a sole structure.

The present disclosure provides a lightweight article of footwear. More specifically, the present disclosure provides an article of footwear that may include a sole structure and an upper secured to the sole structure and configured to receive a foot. The sole structure may comprise a lasting board and sole plate construction. In some embodiments, one of the lasting board and sole plate may have an opening along the center such that there is little to no overlap, or lamination, between the lasting board and the sole plate along the center of the article of footwear. Such a construction may eliminate weight while maintaining the support provided by the layers of the sole structure. Additionally, such a construction may enhance flexibility and may make the wearer feel closer to the ground by reducing the material between the wearer and the ground. In some embodiments, the article of footwear may include an insole. In some embodiments, the sole structure of the article of footwear may consist of an insole, a lasting board, and a sole plate.

The following discussion and accompanying figures disclose a sole structure for an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a sole structure, i.e., extending from a forefoot portion to a heel portion of the sole. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole. In other words, the lateral direction may extend between a medial side and a lateral side of an article of footwear, with the lateral side of the article of footwear being the surface that faces away from the other foot, and the medial side being the surface that faces toward the other foot.

The term "lateral axis," as used throughout this detailed description and in the claims, refers to an axis oriented in a lateral direction.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction. The term "ground side" shall refer to the direction toward a ground surface when a wearer is donning the article of footwear and is standing flat-footed on the ground surface. The term "foot side" shall refer to the direction toward a wearer's foot when a wearer is donning the article of footwear and is standing flat-footed on the ground surface.

The "interior" of a shoe refers to space that is occupied by a wearer's foot when the shoe is worn. The "inner side" of a panel or other shoe element refers to the face of that panel or element that is (or will be) oriented toward the shoe interior in an assembled shoe. The "outer side" of an element refers to the face of that element that is (or will be) oriented away from the shoe interior in the assembled shoe. In some cases, the inner side of an element may have other elements between that inner side and the interior in the assembled shoe. Similarly, an outer side of an element may have other elements between that outer side and the space external to the assembled shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

As discussed in further detail below with respect to the exemplary embodiments, and as previously stated, the article of footwear may include a sole structure and an upper secured to the sole structure. The sole structure may include a lasting board and a sole plate. The lasting board may overlie the ground side surface of the article of footwear and the sole plate may overlie the lasting board. In some embodiments, the lasting board may extend over the entire area of the ground side surface of the article of footwear and the sole plate may overlie the lasting board. For example, FIGS. 1-5, discussed in more detail below, show an embodiment in which an article of footwear 100 may include a lasting board 104 that may cover the entire area of the ground side surface of article of footwear 100. Such a lasting board may enhance the security of the connection between the upper and the sole structure. In other embodiments, the lasting board may be a partial lasting board. In other words, the lasting board may extend only partially along the bottom (ground side) surface of the article of footwear. For example, the lasting board may be sized and shaped to overlie half of the ground side surface of the article of footwear. Such a lasting board may enhance the flexibility of the sole structure. FIGS. 6-10 and 12, discussed in more detail below, show an embodiment in which an article of footwear 600 includes a lasting board 702 that may cover a portion of the area of the ground side surface of article of footwear 600.

In some embodiments, the lasting board may be a solid lasting board without an opening. For example, FIGS. 1-5 show an embodiment in which lasting board 104 may be solid. In such embodiments, the lasting board may be disposed beneath a sole plate having an opening configured such that the lasting board forms part of the ground-engaging surface of the article of footwear along with the sole plate. In other embodiments, the lasting board may include openings that cause the lasting board not to extend continuously along the spaced bounded by the peripheral edge of the article of footwear. Such an embodiment may include openings that correspond with solid sections of the sole plate so that the shoe has a continuous ground-engaging surface. In some embodiments, the lasting board may include an opening in a central area of the lasting board. For example, FIGS. 6-10 and 12 show an embodiment in which an opening 704 may extend through lasting board 702. In such an embodiment, the lasting board may help connect the upper to the sole structure of the shoe while being of minimal size to reduce the weight and increase the flexibility of the article of footwear.

In some embodiments, the sole plate may extend along a peripheral area of the lasting board to provide protection to the peripheral area of the lasting board and to supply another level of support along the peripheral area of a ground side surface of the article of footwear. For example, as shown in FIG. 1, sole plate 102 may extend along the peripheral area of the lasting board 104. In some embodiments, an opening may be disposed in a central area of the sole plate to expose a central area of the lasting board such that the sole plate and the exposed central area of the lasting board together form the ground-engaging surface of the article of footwear. For example, as shown in the embodiment of FIGS. 1-5, sole plate 102 may have an opening 150 extending through sole plate 102. In this type of construction, the lasting board may facilitate lasting the upper and the lasting board may also provide a portion of the ground-engaging surface of the article of footwear. In other embodiments, the sole plate may be a solid sole plate without an opening. For example, FIGS. 6-10 and 12 show an embodiment in which sole plate 602 may be solid. In some embodiments, such a solid sole plate may overlie a lasting board that covers only a portion of the ground side surface of the article of footwear.

As previously stated, the article of footwear may include a solid lasting board and sole plate having an opening. FIGS. 1-5, now discussed in detail, depict such an exemplary embodiment of an article of footwear. Article of footwear 100 may include a sole plate having an opening such that a central area of the lasting board is exposed and the ground side surface of sole plate and the ground side surface of the lasting board together form the ground-engaging surface of the article of footwear. Providing an opening in the sole plate may reduce the thickness of the sole structure in the location of the opening. Such a reduction in thickness may increase flexibility of the sole structure, decrease the weight of the article of footwear, and make the wearer feel closer to the ground by reducing the material between the wearer and the ground.

Figure 2A:
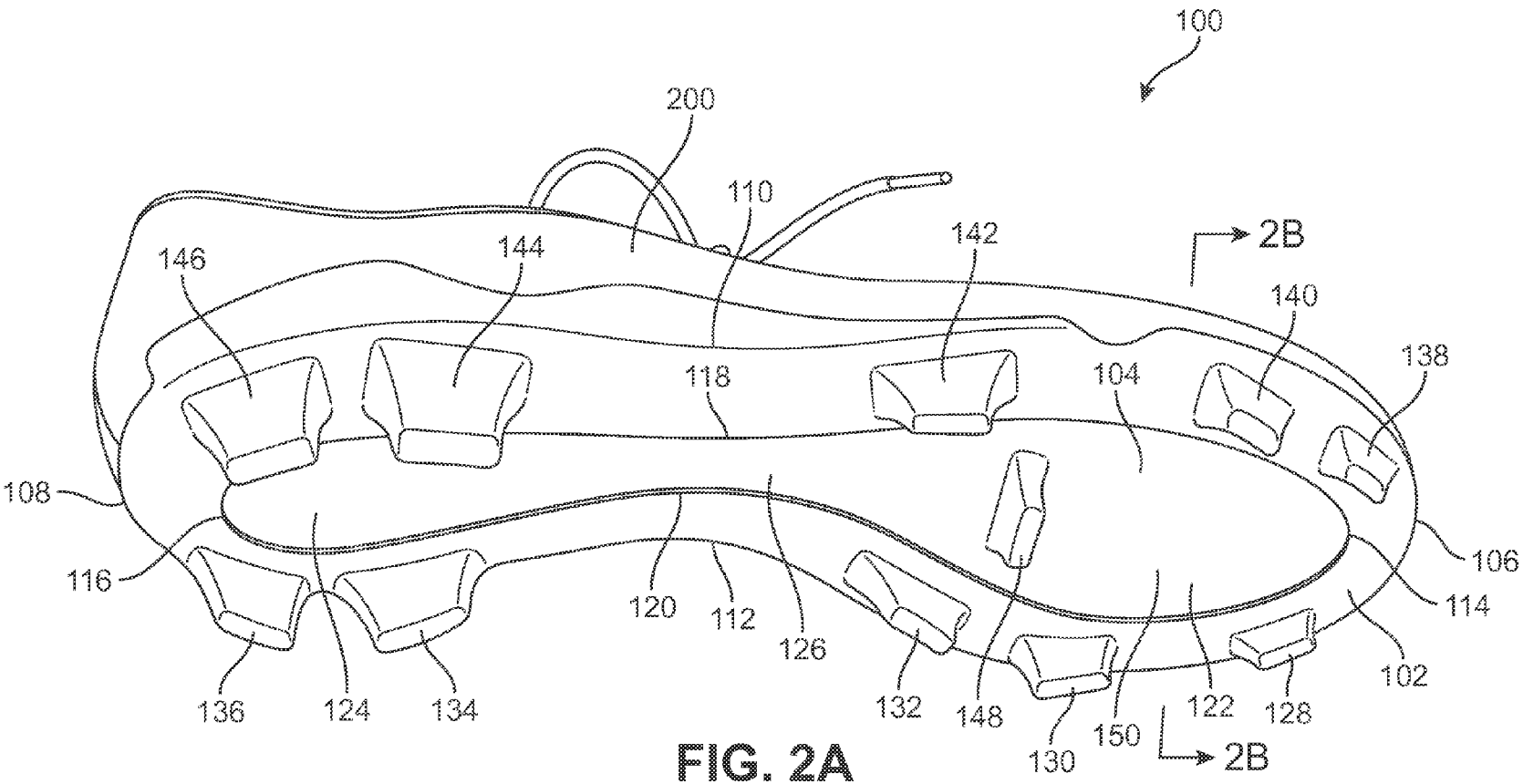
FIG. 2A shows a perspective view of the upper and the sole structure of the embodiment shown in FIG. 1.
Figure 2B:
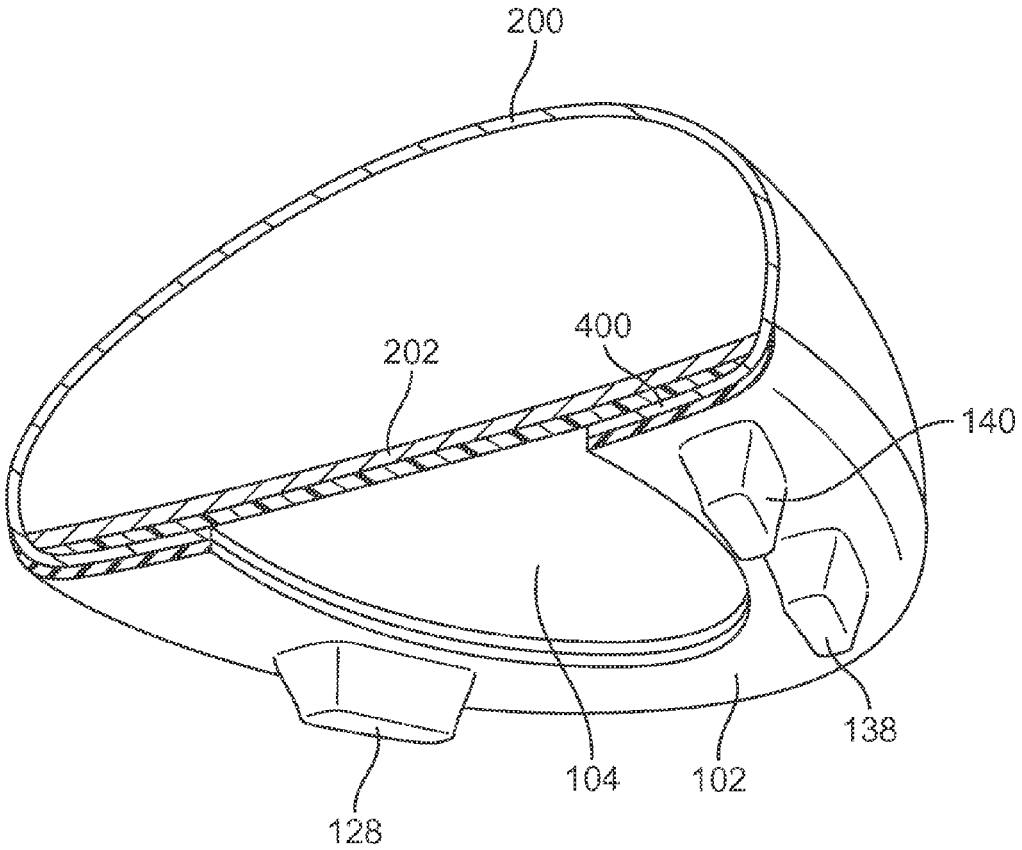
FIG. 2B shows a cross section of the article of footwear of the embodiment shown in FIG. 2A.
Figure 3:
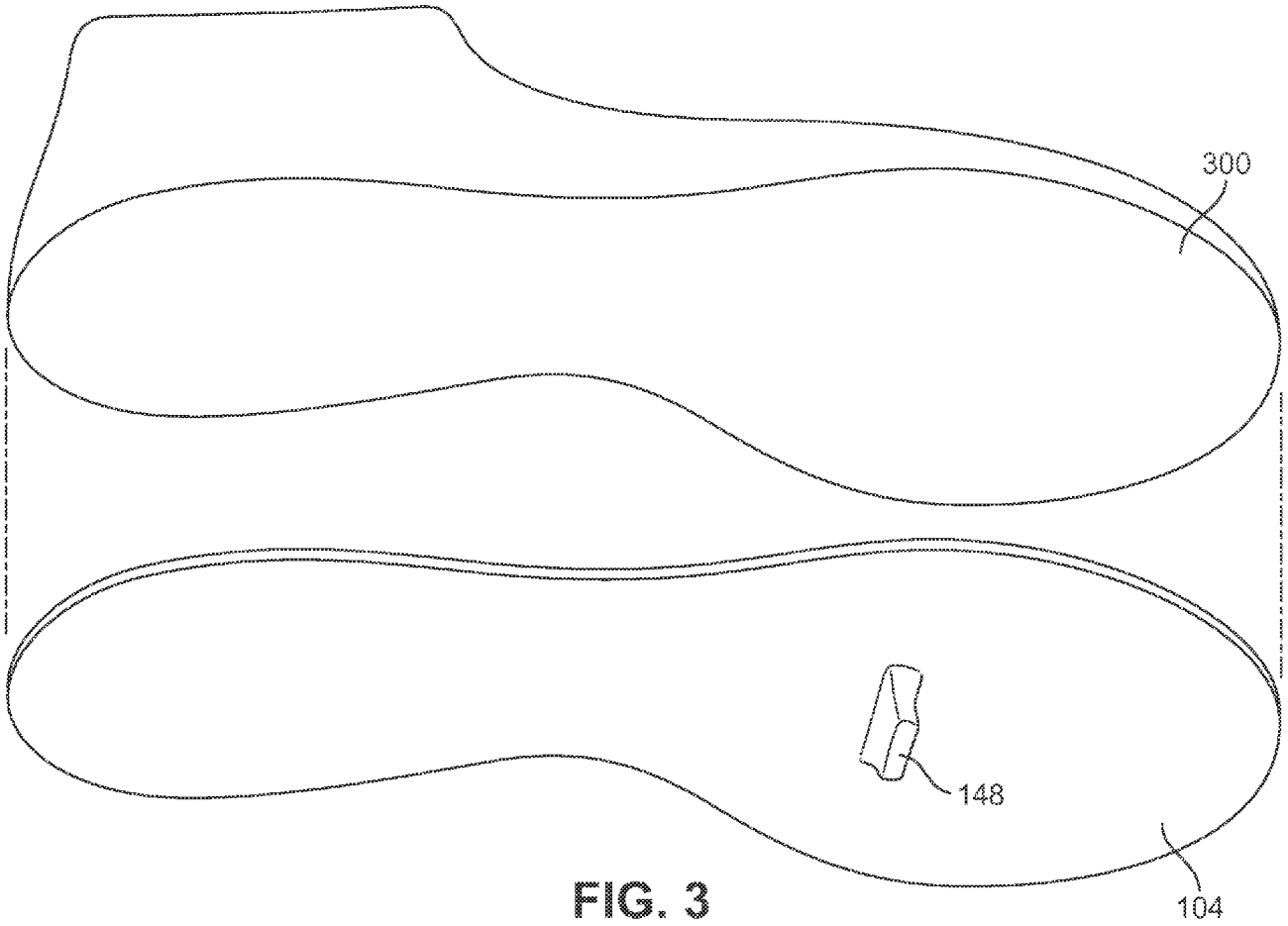
FIG. 3 shows how the lasting board of the embodiment shown in FIG. 1 may be aligned with a last (foot form) during assembly.
Figure 4:
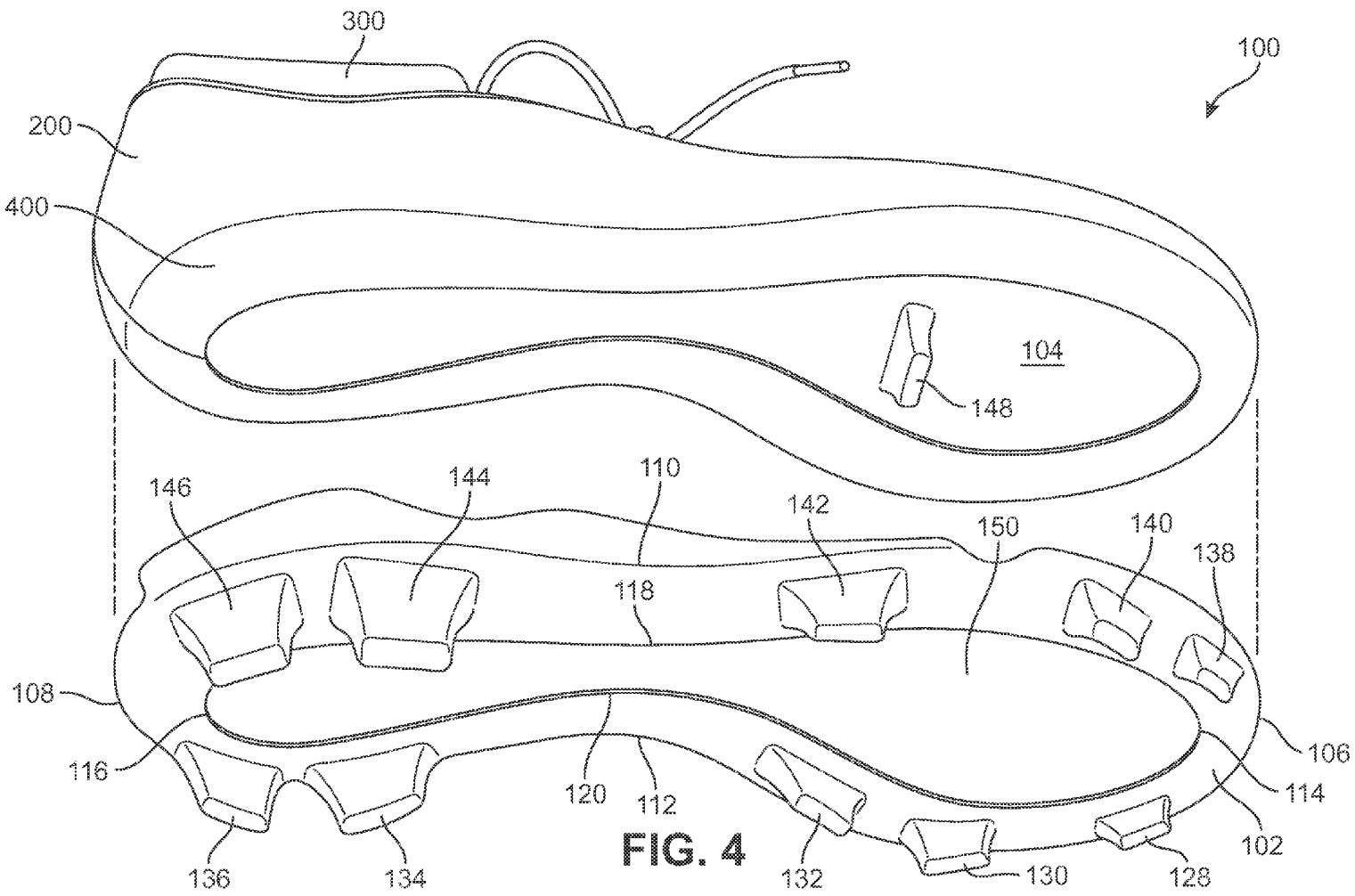
FIG. 4 shows how the sole plate of the embodiment shown in FIG. 1 may be aligned with the last and the lasting board during assembly.
Figure 5:
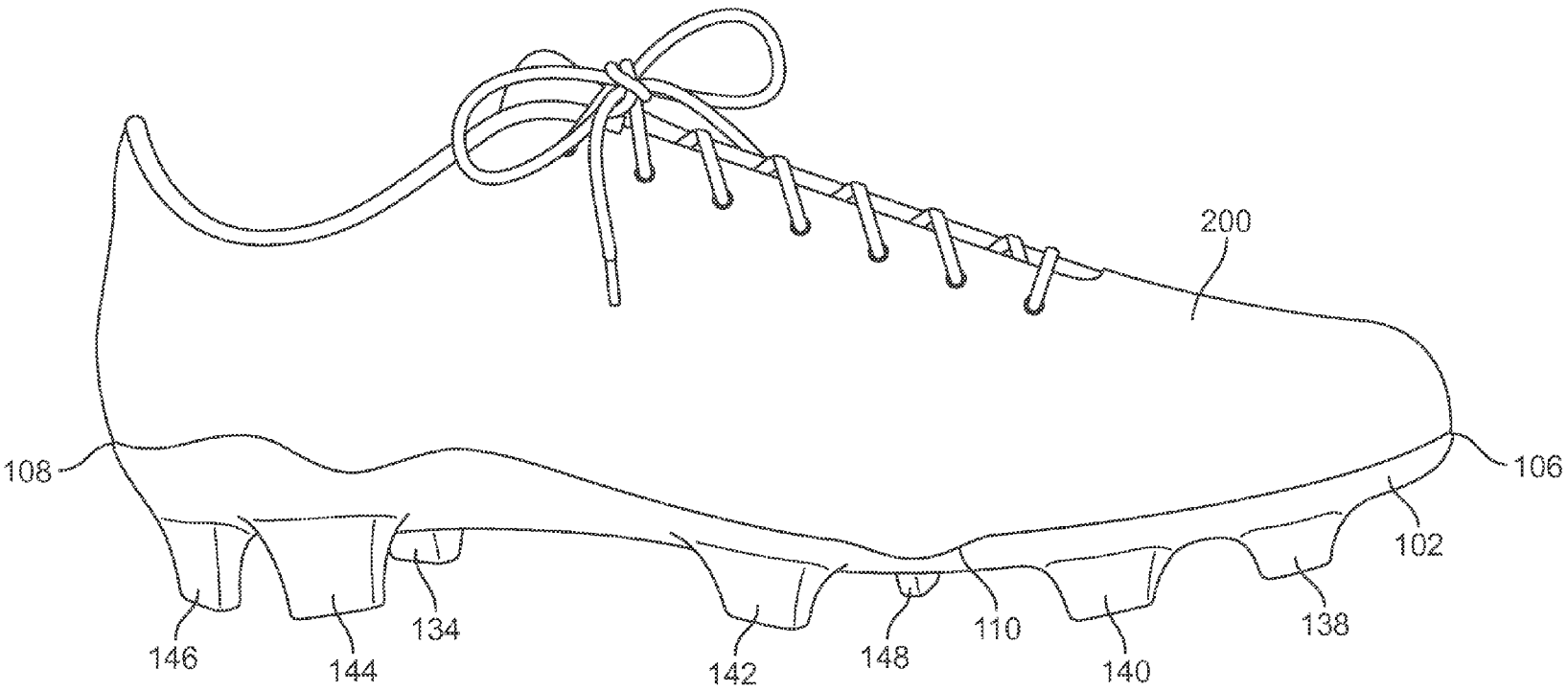
FIG. 5 shows a side view of the embodiment of the article of footwear in FIG. 1 in the assembled condition.

FIG. 1 shows a bottom view of the sole structure. FIG. 2A shows a perspective view of the sole structure and upper 200. FIG. 3 shows how lasting board 104 may be aligned with a last (foot form) 300 during assembly. FIG. 4 shows how sole plate 102 may be aligned with last 300 and lasting board 104 during assembly. FIG. 5 shows a side view of article of footwear 100 in the assembled condition. While the exemplary embodiments are shown as a right shoe, it is understood that a left shoe may include the same features in a mirror image configuration. For reference purposes, footwear 100 may be divided into three general regions: a forefoot region 122, a heel region 124, and a midfoot region 126 disposed between forefoot region 122 and heel region 124. Forefoot region 122 generally includes portions of footwear 100 corresponding with the toes and the joints connecting the metatarsals with the phalanges. Midfoot region 126 generally includes portions of footwear 100 corresponding with an arch area of the foot. Heel region 124 generally corresponds with rear portions of the foot, including the calcaneus bone. Since various features of footwear 100 extend beyond one region of footwear 100, the terms forefoot region 122, midfoot region 126, and heel region 124 apply not only to footwear 100, but also to the various features of footwear 100. Article of footwear 100 may include a longitudinal axis A extending between a lateral side and a medial side of the sole structure. Longitudinal axis A may extend from a forward edge of article of footwear 100 to a rearward edge of article of footwear 100.

Lasting board 104 may include a ground side surface and a foot side surface opposite the ground side surface. The ground side surface of lasting board 104 may have a peripheral area extending along a peripheral edge of the lasting board. The ground side surface of lasting board 104 may have a central area disposed inside of the peripheral area. The central area of the ground side surface of the lasting board may be bounded by the peripheral area of the ground side surface of the lasting board. As described in more detail below, lasting board 104 may be a solid piece extending along the entire bottom side of the article of footwear in the assembled condition.

Sole plate 102 may have a ground side surface and a foot side surface opposite the ground side surface. Sole plate 102 may have an outer peripheral edge including an outer forward edge 106, an outer rearward edge 108 disposed opposite outer forward edge 106, an outer lateral edge 110, and an outer medial edge 112 disposed opposite outer lateral edge 110. Sole plate 102 may have an inner peripheral edge defining an opening 150. The inner peripheral edge of the sole plate may be substantially parallel to the outer peripheral edge of the sole plate. The inner peripheral edge may include an inner forward edge 114, an inner rearward edge 116 disposed opposite inner forward edge 114, an inner lateral edge 118, and an inner medial edge 120 disposed opposite inner lateral edge 118. Inner forward edge 114 may be spaced from inner rearward edge 116 by opening 150. Opening 150 in sole plate 102 may extend along a majority of longitudinal axis A of the article of footwear. Inner lateral edge 118 may be spaced from inner medial edge 120 by opening 150. Sole plate 102 may have a width defined between the inner peripheral edge and the outer peripheral edge. The width of sole plate 102 may be substantially constant along the entire sole plate. The outer medial edge of sole plate 102 may be spaced from the outer lateral edge by a first distance. A second distance may be defined between the inner medial edge of sole plate 102 and the inner lateral edge of sole plate 102. The second distance may be substantially greater than half of the first distance. The geometric area bounded by the outer peripheral edge of sole plate 102 may be substantially the same as the geometric area bounded by the peripheral edge of the lasting board.

In some embodiments, the ground side surface of sole plate 102 may carry one or more cleats, studs, or protrusions of various shapes and sizes. For example, as shown in FIG. 1, a plurality of cleats may extend from sole plate 102. A first medial cleat 128 and a second medial cleat 130 may extend from sole plate 102 on the medial side of sole plate 102 in the forefoot region of sole plate 102. A third medial cleat 132 may extend from sole plate 102 on the medial side of sole plate 102 in the midfoot region of sole plate 102. A fourth medial cleat 134 and a fifth medial cleat 136 may extend from sole plate 102 on the medial side of sole plate 102 in the heel region of sole plate 102. A first lateral cleat 138 and a second lateral cleat 140 may extend from sole plate 102 on the lateral side of sole plate 102 in the forefoot region of sole plate 102. A third lateral cleat 142 may extend from sole plate 102 on the lateral side of sole plate 102 in the midfoot region of sole plate 102. A fourth lateral cleat 144 and a fifth lateral cleat 146 may extend from sole plate 102 on the lateral side of sole plate 102 in the heel region of sole plate 102. While 10 cleats are shown in the embodiment of FIG. 1, it is understood that sole plate 102 may include any number of cleats. For example, sole plate 102 may include between 1 and 20 cleats. It is understood that other types of cleats, studs, and/or protrusions may be included on sole plate 102 in place of or in addition to the cleats shown in FIG. 1. For example, protrusions significantly smaller than the cleats shown in FIG. 1 and spaced closer together than the cleats shown in FIG. 1 may cover the ground side surface of sole plate 102. In yet other embodiments, the ground side surface of sole plate 102 may be free of cleats, studs, or protrusions. The number, size, and shape of the cleats, studs, and/or protrusions may be selected based on a variety of factors, such as the type of sport the article of footwear is used for and/or the conditions (e.g., indoor or outdoor) the article of footwear is to be worn on.

In some embodiments, the ground side surface of lasting board 104 may carry one or more cleats, studs, or protrusions of various shapes and sizes. For example, as shown in FIG. 1, a lasting board cleat 148 may extend from the ground side surface of lasting board 104. Lasting board cleat 148 may be positioned in a central area of lasting board 104 in the forefoot region of lasting board 104. While lasting board 104 is shown with a single cleat in FIG. 1, lasting board 104 may include a plurality of cleats. For example, in some embodiments, lasting board 104 may include between 2 and 10 cleats. In other embodiments, the ground side surface of lasting board 104 may be covered in small protrusions that are spaced close together. In yet other embodiments, the ground side surface of lasting board 104 may be free of cleats, studs, or protrusions. The number, size, and shape of the cleats, studs, and/or protrusions may be selected based on a variety of factors, such as the type of sport the article of footwear is used for, the conditions (e.g., indoor or outdoor) the article of footwear is to be worn on, and/or the number, size, and shape of the cleats, studs, and/or protrusions disposed on the sole plate.

FIGS. 1, 2A, 2B, and 5 show article of footwear 100 after assembly that will now be described in detail. Understanding the construction of article of footwear 100 may be facilitated by viewing a method of making article of footwear 100 shown in FIGS. 3-4. FIG. 3 shows lasting board 104 being aligned with a last 300 during assembly. Lasting board 104 may be placed against a bottom surface of last 300 such that the foot side surface of lasting board 104 contacts the bottom surface of last 300 and the ground side surface of lasting board 104 faces away from the bottom surface of last 300. The outer forward edge of lasting board 104 may be aligned with a forward edge so that the outer forward edge of lasting board 104 may align with the forward edge of the article of footwear after assembly. Similarly, the outer medial edge of lasting board 104 may be aligned with the medial edge of last 300 so that the outer medial edge of lasting board 104 may align with the medial edge of the article of footwear after assembly. The outer lateral edge of lasting board 104 may be aligned with the lateral edge of last 300 so that the outer lateral edge of lasting board 104 may align with the lateral edge of the article of footwear after assembly. The outer rearward edge of lasting board 104 may be aligned with a rearward edge of last 300 so that the outer rearward edge of lasting board 104 may be aligned with the rearward edge of the article of footwear after assembly. In the assembled condition, the lasting board may extend continuously from a forward edge of the article of footwear to a rearward edge of the article of footwear and the lasting board may extend continuously from a medial edge of the article of footwear to the lateral edge of the article of footwear. In some embodiments, lasting board 104 may extend continuously along the space bounded by the entire peripheral edge of the article of footwear. In other words, lasting board 104 may extend continuously along the space bounded by the entire forward edge, the entire rearward edge, the entire lateral edge, and the entire medial edge of the article of footwear.

As shown in FIG. 4, upper 200 may be stretched around last 300 and lasting board 104. Last 300 may have the same shape that the upper will have when the article of footwear is assembled. Stretching upper 200 over last 300 may impart the shape of last 300 to upper 200. FIG. 4 shows how upper 200 may be stretched such that a lower portion 400 of upper 200 is pulled down around a peripheral area of lasting board 104 such that a central area of lasting board 104, which may be disposed within the peripheral area of lasting board 104, is exposed. In other words, lower portion 400 of upper 200 may be sized, shaped, and positioned such that lower portion 400 of upper 200 does not overlap with the center of lasting board 104. In some embodiments, upper 200 may be cut to prevent lower portion 400 of upper 200 from overlapping with the center of lasting board 104 after upper 200 has already been stretched over last 300 and lasting board 104. Upper 200 may be secured to the peripheral area of the ground side surface of lasting board 104. Lower portion 400 of upper 200 may overlap with and be secured to the peripheral area of lasting board 104. For example, in some embodiments, lower portion 400 of upper 200 may be adhered to lasting board 104 by any suitable method, e.g., stitching, welding, heat bonding, and/or adhering.

Once lower portion 400 of upper 200 is secured to lasting board 104, sole plate 102 may be aligned with lasting board 104 (FIG. 4) and the foot side surface of sole plate 102 may be secured to lower portion 400 of upper 200. In some embodiments, sole plate 102 may also be secured over a portion of lasting board 104 such that at least the central area of lasting board 104 is exposed. In the assembled condition, lasting board 104 may be disposed between an insole and lower portion 400 of upper 200. For example, the peripheral area of lasting board 104 may be disposed between an insole 202 (FIG. 2B) and lower portion 400 of upper 200.

In the assembled condition, lower portion 400 of upper 200 may be disposed between lasting board 104 and sole plate 102. Specifically, lower portion 400 of upper 200 may be disposed between the ground side surface of lasting board 104 and the foot side surface of sole plate 102.

As previously stated, the article of footwear may include a lasting board having an opening and a solid sole plate covering the lasting board. For example, FIGS. 6-10 and 12, now discussed in detail, show such an exemplary embodiment. Article of footwear 600 may include a lasting board having an opening and a sole plate that may cover the entire area of the bottom of article of footwear, including the entire ground side surface of the lasting board such that a ground side surface of sole plate may independently form the ground-engaging surface of the article of footwear. Providing an opening in the lasting board may reduce the thickness of the sole structure in the location of the opening. Such a reduction in thickness may increase flexibility of the sole structure, decrease the weight of the article of footwear, and make the wearer feel closer to the ground by reducing the material between the wearer and the ground.

Figure 6:
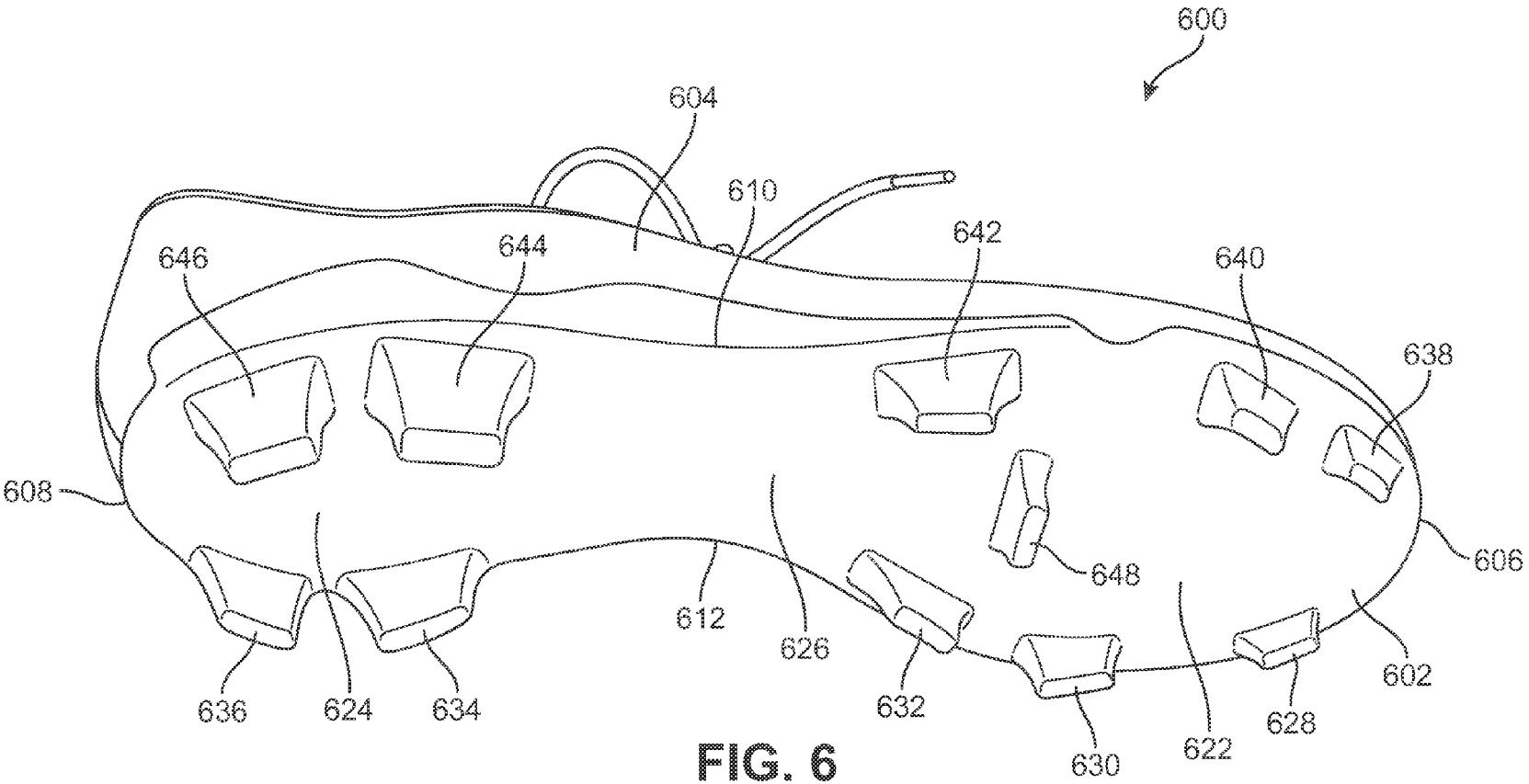
FIG. 6 shows an embodiment of an article of footwear having a sole structure.
Figure 7:
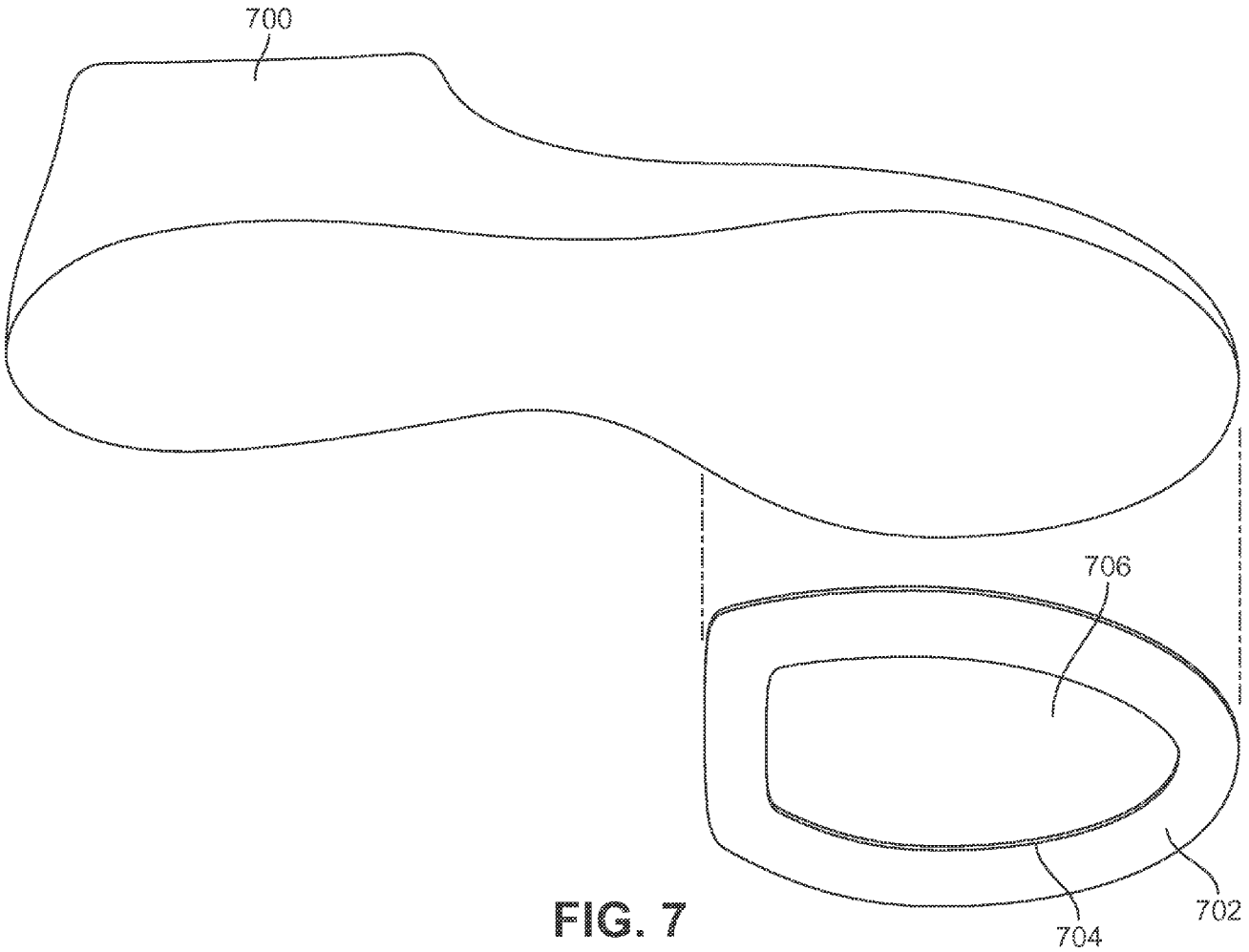
FIG. 7 shows how the lasting board of the sole structure of the embodiment shown in FIG. 6 may be aligned with a last (foot form) during assembly.
Figure 8:
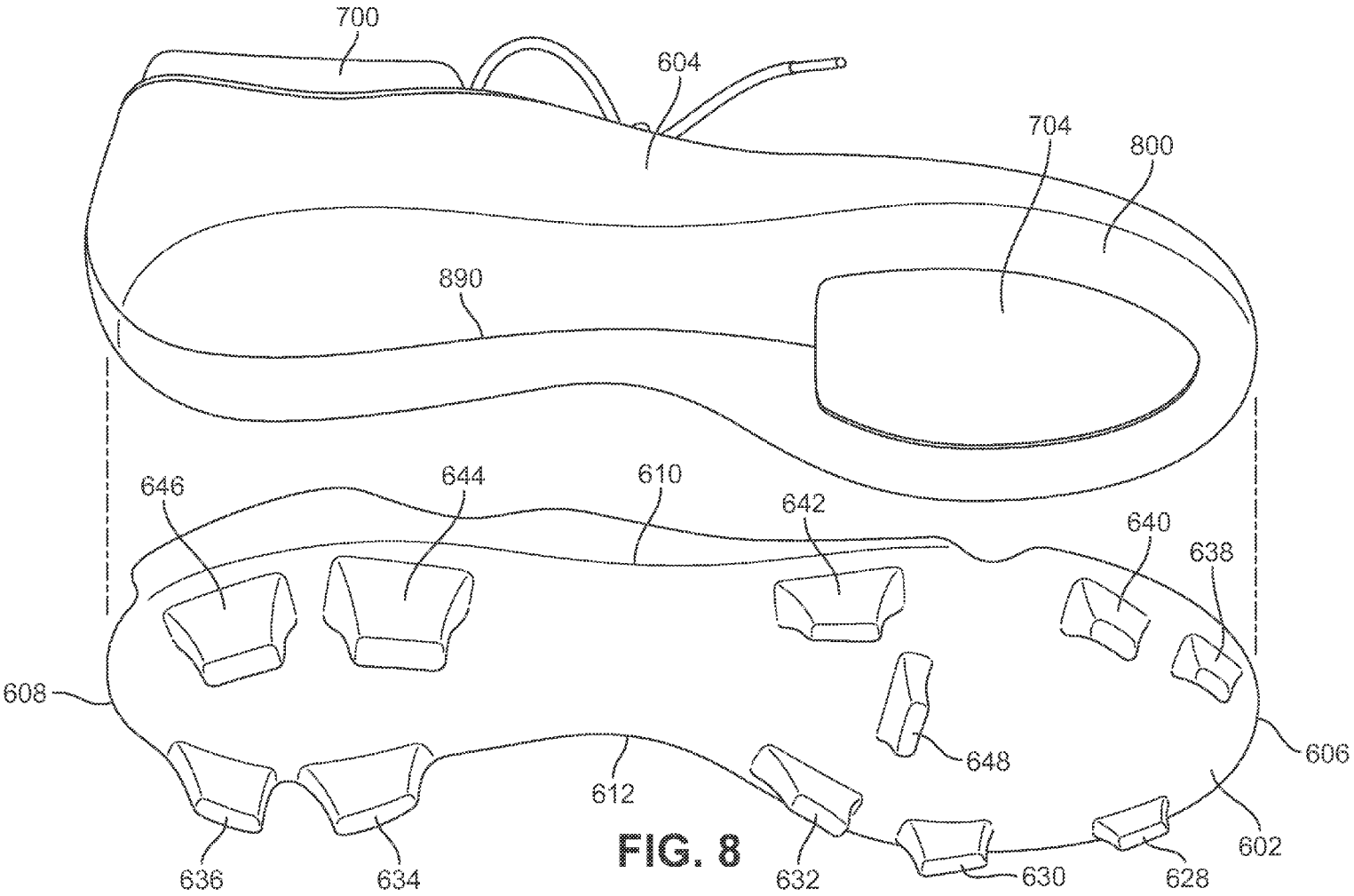
FIG. 8 shows how the sole plate of the embodiment shown in FIG. 6 may be aligned with the last and the lasting board during assembly.
Figure 9:
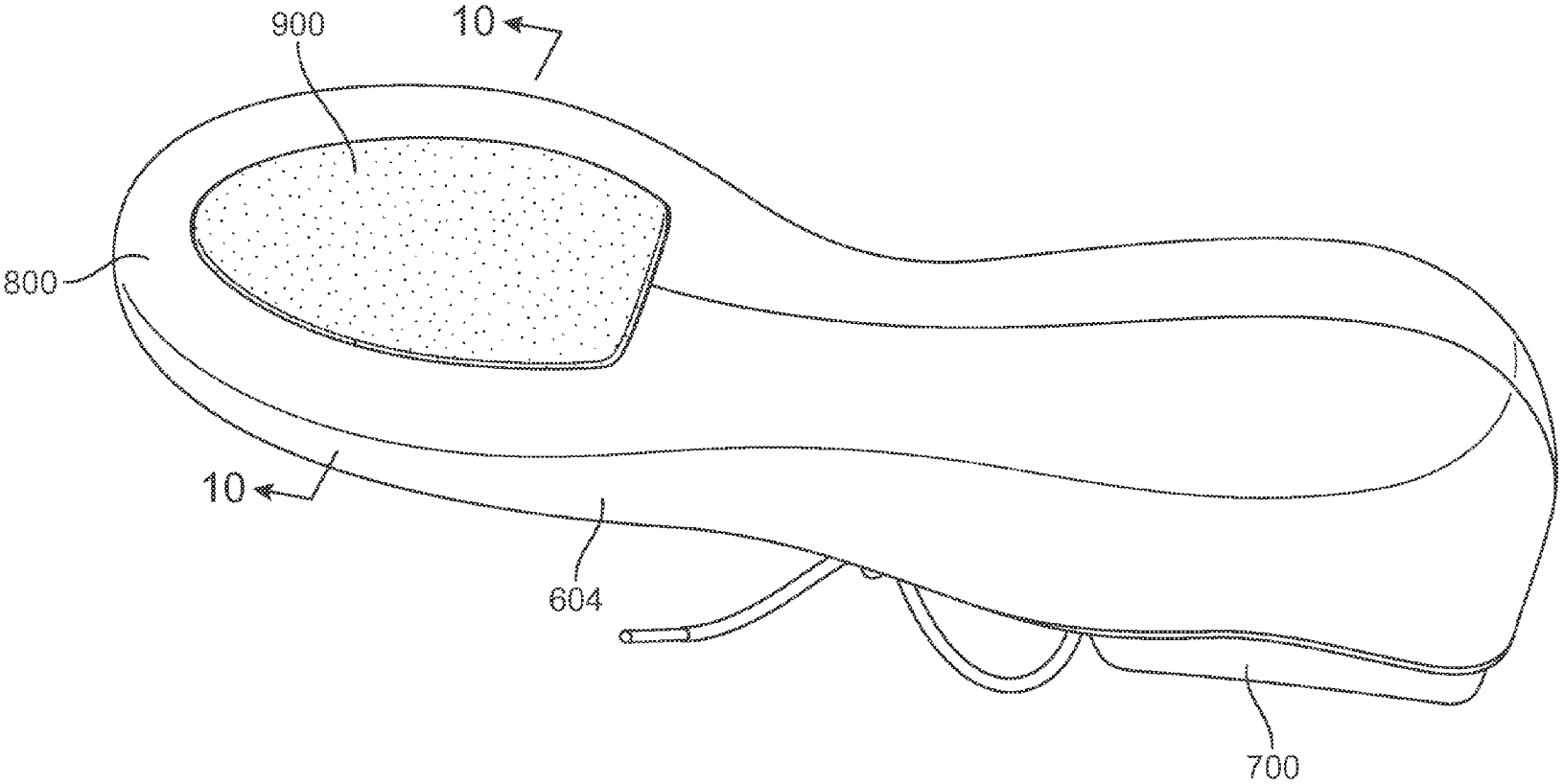
FIG. 9 shows a bottom perspective view of the article of footwear of the embodiment shown in FIG. 6 with an insole disposed inside a cavity formed by the upper without a sole plate covering the ground side surface of the article of footwear.
Figure 10:
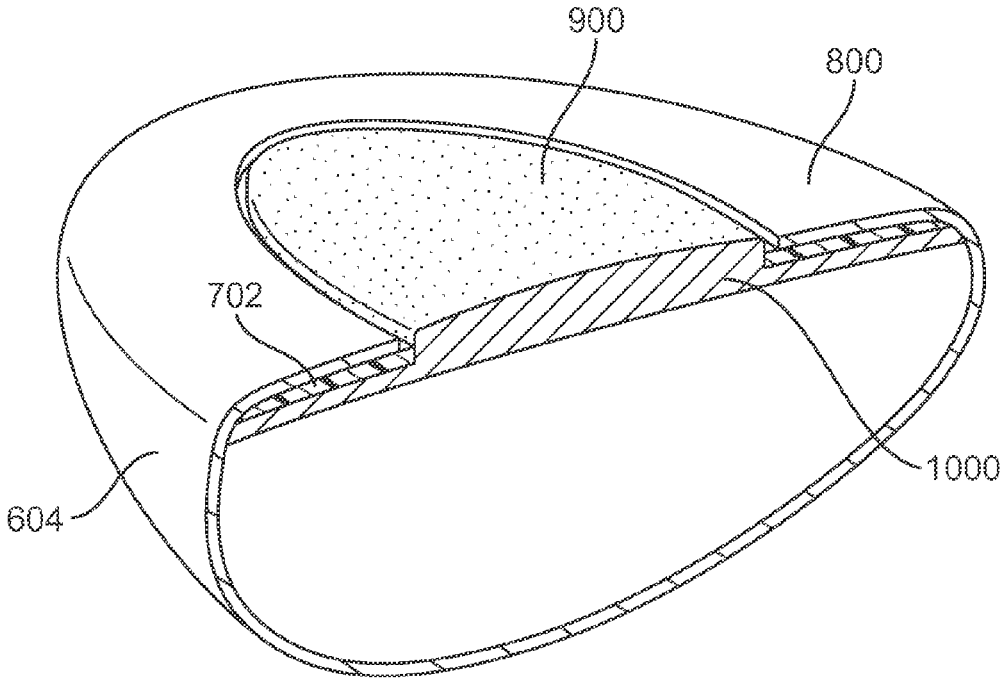
FIG. 10 shows a cross section of the article of footwear of the embodiment shown in FIG. 6 with an insole disposed inside a cavity formed by the upper without a sole plate covering the ground side surface of the article of footwear.
Figure 12:
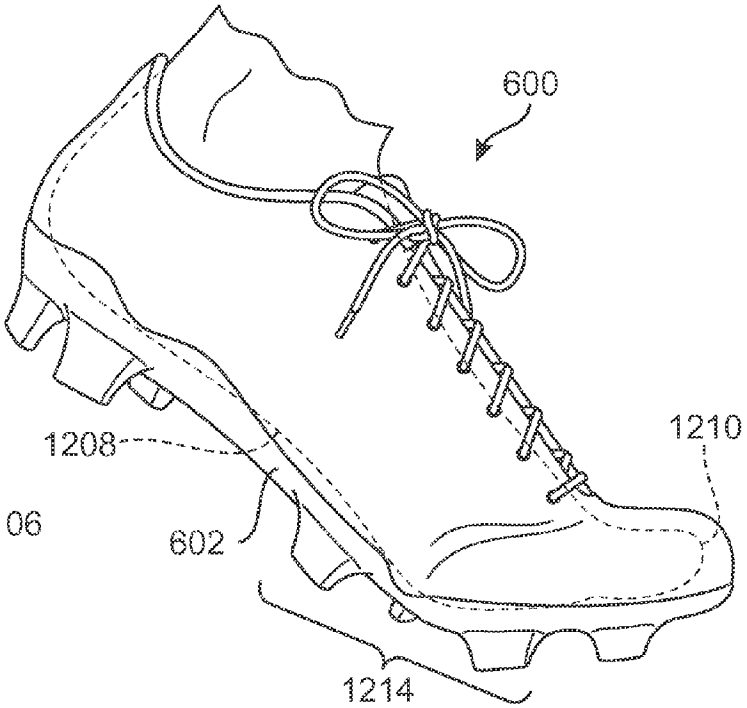
FIG. 12 shows the article of footwear of the embodiment shown in FIG. 6 in a flexed position.

FIG. 6 shows a perspective view of the assembled article of footwear. FIG. 7 shows how lasting board 702 may be aligned with a last (foot form) 700 during assembly. FIG. 8 shows how sole plate 602 may be aligned with last 700 and lasting board 702 during assembly. FIGS. 9 and 10 show article of footwear 600 with an insole disposed inside a cavity formed by upper 604 without a sole plate covering the ground side surface of the article of footwear. FIG. 12 shows the assembled article of footwear in a flexed position. While the exemplary embodiments are shown as a right shoe, it is understood that a left shoe may include the same features in a mirror image configuration. For reference purposes, footwear 600 may be divided into three general regions: a forefoot region 622, a heel region 624, and a midfoot region 626 disposed between forefoot region 622 and heel region 624. Forefoot region 622 generally includes portions of footwear 600 corresponding with the toes and the joints connecting the metatarsals with the phalanges. Midfoot region 626 generally includes portions of footwear 600 corresponding with an arch area of the foot. Heel region 624 generally corresponds with rear portions of the foot, including the calcaneus bone. Since various features of footwear 600 extend beyond one region of footwear 600, the terms forefoot region 622, midfoot region 626, and heel region 624 apply not only to footwear 600, but also to the various features of footwear 600. Article of footwear 600 may include a longitudinal axis extending between a lateral side and a medial side of the sole structure. The longitudinal axis may extend from a forward edge of article of footwear 600 to a rearward edge of article of footwear 600.

Lasting board 702 may have a ground side surface and a foot side surface opposite the ground side surface. Lasting board 702 may have an outer peripheral edge including an outer forward edge, an outer rearward edge disposed opposite the outer forward edge, an outer lateral edge, and an outer medial edge disposed opposite the outer lateral edge. Lasting board 702 may have an inner peripheral edge defining opening 704. The inner peripheral edge of the sole plate may be substantially parallel to an outer peripheral edge of the sole plate. Lasting board 702 may have a width defined between the inner peripheral edge and the outer peripheral edge. This width of lasting board 702 may be substantially constant along the entire lasting board. The inner peripheral edge may include an inner forward edge, an inner rearward edge disposed opposite the inner forward edge, an inner lateral edge, and an inner medial edge disposed opposite the inner lateral edge. The inner forward edge may be spaced from the inner rearward edge by opening 704. The inner medial edge may be spaced from the inner lateral edge by opening 704. The outer medial edge of lasting board 702 may be spaced from the outer lateral edge of lasting board 702 by a first distance. A second distance may be defined between the inner medial edge of lasting board 702 and the inner lateral edge of lasting board 702. The second distance may be substantially greater than half of the first distance. Opening 704 in lasting board 702 may extend along a majority of a longitudinal axis of lasting board 702.

In some embodiments, the lasting board may extend along a portion of the peripheral area of the article of footwear to facilitate lasting an upper. For example, as shown in FIG. 7, lasting board 702 may be sized and shaped to extend along a portion of the peripheral area of the forefoot region of the article of footwear. A portion of lasting board 702 may sized and shaped to extend from a medial edge of article of footwear 600 across a midfoot region of the article of footwear to a lateral edge of article of footwear 600. In the assembled condition, lasting board 702 may extend from a forefoot edge of the article of footwear to a point disposed in the midfoot region of the article of footwear and lasting board 702 may terminate at the point disposed in the midfoot region. The outer forward edge of lasting board 702 may be spaced from the outer rearward edge of the lasting board by a distance that is substantially less than half of the distance between the forward edge of article of footwear 600 and the rearward edge of article of footwear 600. Due to the fact that lasting board 702 may be disposed mainly in the forefoot region of the article of footwear, lasting board 702 may be considered a toe board. Providing the lasting board as a toe board may further enhance the flexibility and resilience of the sole structure. In some embodiments, the lasting board may extend from the forward edge of the article of footwear to the rearward edge of the article of footwear. In such embodiments, an opening in the lasting board may extend along a majority of the longitudinal axis of the article of footwear.

Sole plate 602 may include a ground side surface and a foot side surface opposite the ground side surface. As described in more detail below, sole plate 602 may be a solid piece extending along the entire bottom side of the article of footwear in the assembled condition.

In some embodiments, the ground side surface of sole plate 602 may carry one or more cleats, studs, or protrusions of various shapes and sizes. For example, as shown in FIG. 6, a plurality of cleats may extend from sole plate 602. A first medial cleat 628 and a second medial cleat 630 may extend from sole plate 602 on the medial side of sole plate 602 in the forefoot region of sole plate 602. A third medial cleat 632 may extend from sole plate 602 on the medial side of sole plate 602 in the midfoot region of sole plate 602. A fourth medial cleat 634 and a fifth medial cleat 636 may extend from sole plate 602 on the medial side of sole plate 602 in the heel region of sole plate 602. A first lateral cleat 638 and a second lateral cleat 640 may extend from sole plate 602 on the lateral side of sole plate 602 in the forefoot region of sole plate 602. A third lateral cleat 642 may extend from sole plate 602 on the lateral side of sole plate 602 in the midfoot region of sole plate 602. A fourth lateral cleat 644 and a fifth lateral cleat 646 may extend from sole plate 602 on the lateral side of sole plate 602 in the heel region of sole plate 602. A central cleat 648 may extend from a central area of sole plate 602 in the forefoot region of sole plate 602. While 11 cleats are shown in the embodiment of FIG. 6, it is understood that sole plate 602 may include any number of cleats. For example, sole plate 602 may include between 1 and 20 cleats. It is understood that other types of cleats, studs, and/or protrusions may be included on sole plate 602 in place of or in addition to the cleats shown in FIG. 6. For example, protrusions significantly smaller than the cleats shown in FIG. 6 and spaced closer together than the cleats shown in FIG. 6 may cover the ground side surface of sole plate 602. In yet other embodiments, the ground side surface of sole plate 602 may be free of cleats, studs, or protrusions. The number, size, and shape of the cleats, studs, and/or protrusions may be selected based on a variety of factors, such as the type of sport the article of footwear is used for and/or the conditions (e.g., indoor or outdoor) the article of footwear is to be worn on.

FIGS. 6 and 12 show article of footwear 600 after assembly that will now be described in detail. Understanding the construction of article of footwear 600 may be facilitated by viewing a method of making article of footwear 600 shown in FIGS. 7-8. FIG. 7 shows lasting board 702 being aligned with a last 700. Lasting board 702 may be placed against a bottom surface of last 700 such that the foot side surface of lasting board 702 contacts the ground side (bottom) surface of last 700 and the ground side surface of lasting board 702 faces away from the bottom surface of last 700. The outer forward edge of lasting board 702 may be aligned with a forward edge so that the outer forward edge of lasting board 702 may align with the forward edge of the article of footwear after assembly. Similarly, the outer medial edge of lasting board 702 may be aligned with the medial edge of last 700 so that the outer medial edge of lasting board 702 may align with the medial edge of the article of footwear after assembly. The outer lateral edge of lasting board 702 may be aligned with the lateral edge of last 700 so that the outer lateral edge of lasting board 702 may align with the lateral edge of the article of footwear after assembly.

As shown in FIG. 8, upper 604 may be stretched around last 700 and lasting board 702. Last 700 may have the same shape that the upper will have when the article of footwear is assembled. Stretching upper 604 over last 700 may impart the shape of last 700 to upper 604. FIG. 8 shows how upper 604 may be stretched such that a lower portion 800 of upper 604 is pulled down around a peripheral area of lasting board 702 such that a central area of lasting board 702, which may be disposed within the peripheral area of lasting board 702, is exposed. In other words, lower portion 800 of upper 604 may be sized, shaped, and positioned such that lower portion 800 of upper 604 does not overlap with the center of lasting board 702. In other embodiments, upper 604 may be sized, shaped, and positioned such that a lower portion of the upper overlaps with the center of lasting board. In some embodiments, upper 604 may be cut to prevent lower portion 800 of upper 604 from overlapping with the center of lasting board 702 after upper 604 has already been stretched over last 700 and lasting board 702. Upper 604 may be secured to the peripheral area of the ground side surface of lasting board 702. Lower portion 800 of upper 604 may overlap with and be secured to the peripheral area of lasting board 702. For example, in some embodiments, lower portion of upper 604 may be secured to lasting board 702 by any suitable method, e.g., stitching, welding, heat bonding, and/or adhering. Edges of lower portion 800 of upper 604 may be secured to one another along a seam 890 in the area that is located rearwardly from lasting board 702 (see FIG. 8). The edges of lower portion 800 may be secured to one another by any suitable method, e.g., stitching, welding, heat bonding, and/or adhering.

Once lower portion of upper 604 is secured to lasting board 702, sole plate 602 may be aligned with lasting board 702 (see FIG. 8) and the foot side surface of sole plate 602 may be secured over lower portion 800 of upper 604 and may overlie lasting board 702. Sole plate 602 may be secured to lower portion 800 of upper 604 such that lower portion 800 is disposed between lasting board 702 and sole plate 602. Specifically, lower portion 800 of upper 604 may be disposed between the ground side surface of lasting board 702 and the foot side surface of sole plate 602. In some embodiments, sole plate 602 may be secured over the entire ground side surface of lasting board 702 such that lasting board 702 is not exposed. In the assembled condition, as shown in FIGS. 6 and 12, sole plate 602 may extend continuously from a forward edge of the article of footwear to a rearward edge of the article of footwear and the sole plate may extend continuously from a medial edge of the article of footwear to a lateral edge of the article of footwear. In some embodiments, sole plate 602 may extend continuously along the space bounded by the entire peripheral edge of the article of footwear. In other words, sole plate 602 may extend continuously along the space bounded by the entire forward edge, the entire rearward edge, the entire lateral edge, and the entire medial edge of the article of footwear.

Referring to FIGS. 9 and 10, insole 1000 may be disposed inside a cavity of the article of footwear. Insole 1000 may have a foot side surface. Insole 1000 may have a ground side surface opposite the foot side surface and disposed adjacent the foot side of lasting board 702. As shown in FIG. 10, lasting board 702 may be disposed between an insole 1000 and lower portion 800 of upper 604. Insole 1000 may have a protrusion 900 sized and shaped to fit within opening 704 of lasting board 702 such that the ground side surface of insole 1000 that is formed by protrusion 900 is substantially flush with the ground side surface of lasting board 702. Insole 1000 may be disposed adjacent the foot side of lasting board 702 and the foot side surface of sole plate 602 may contact the ground side surface of insole 1000 in an area bounded by the inner peripheral edge of opening 704 of lasting board 702. By providing protrusion 900, insole 1000 may maintain a substantially flat foot side surface in the assembled condition. In other words, protrusion 900 may prevent insole 1000 from collapsing into opening 704 such that the foot side surface of insole 1100 is substantially uneven.

Figure 11:
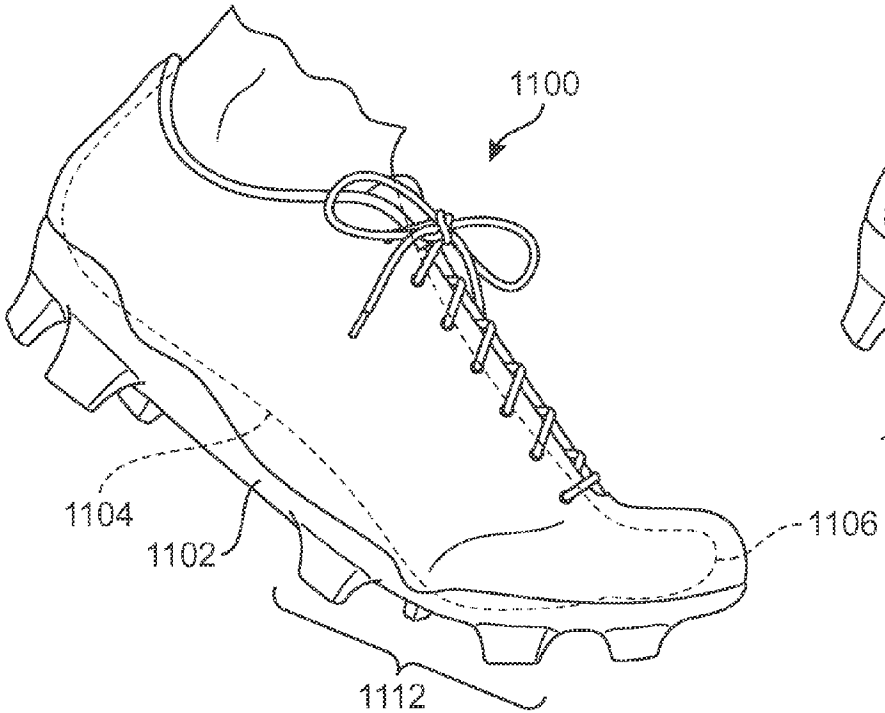
FIG. 11 (Prior Art)
FIG. 11 shows a prior art article of footwear in a flexed position.

FIGS. 11 and 12 demonstrate how an article of footwear having the sole structure shown in FIGS. 6-10 may enhance the flexibility and resilience of the sole structure. FIG. 11 shows a prior art article of footwear 1100 in a flexed position. Article of footwear 1100 may have a sole structure including a solid sole plate 1102 that does not have an opening and a solid lasting board (not shown) that does not include an opening. The lasting board of article of footwear 1100 and sole plate 1102 are laminated along an entire forefoot region of article of footwear 1100.

FIG. 12 shows article of footwear 600 in the same flexed position as article of footwear 1100. In both FIGS. 11 and 12, the wearer is lifting his/her heel while putting weight into the forefoot region of the article of footwear. Since lasting board 702 may be minimal in size due to opening 704 and lasting board 702 is disposed mainly in the forefoot region of article of footwear 600, the sole structure of article of footwear 600 may be more flexible than the sole structure of article of footwear 1100. This difference in flexibility can be seen when comparing region 1112 of article of footwear 1100 with region 1214 of article of footwear 600. Region 1214 bends more sharply than region 1112. In other words, region 1112 appears to be more rounded than region 1214. This rounding of region 1112 is due to the stiffness of the sole structure of article of footwear 1100. Because the sole structure of article of footwear 600 is more flexible than the sole structure of the article of footwear 1100, the space between the wearer's foot 1210 and the bottom of article of footwear 600 in the area indicated by reference number 1208 is smaller than the space between the wearer's foot 1106 and the bottom of article of footwear 1100 in the area indicated by reference number 1104. The flexibility of sole structure of article of footwear 600 causes sole structure of article of footwear 600 to follow wearer's foot 1210 more closely than the sole structure of article of footwear 1100 follows wearer's foot 1106. The flexibility of sole structure of article of footwear 600 also makes the sole structure of article of footwear 600 more resilient and reactive and less restrictive on the motion of a wearer's foot. The resilience of the sole structure of article of footwear 600 may cause the sole structure to snap back into the unbent position as the wearer's foot straightens. This feature causes the sole structure to have more responsiveness.

The lasting board and sole plate of the present disclosure may include any suitable material. For example, the lasting board and/or sole plate may include a thermoplastic polyurethane, a thermoplastic elastomer, leather and/or synthetic leather. The material of the sole plate may be selected and arranged to selectively impart properties such as light weight, durability, air-permeability, wear-resistance, flexibility, and comfort.

The upper of the present disclosure may include one or more material elements (for example, meshes, textiles, foam, leather, and synthetic leather), which may be joined to define an interior void configured to receive a foot. The material elements may be selected and arranged to selectively impart properties such as light weight, durability, air-permeability, wear-resistance, flexibility, and comfort. The upper may define an opening configured to receive a foot of a wearer into the interior void. The material elements may be selected and arranged to selectively impart properties such as light weight, durability, air-permeability, wear-resistance, flexibility, and comfort. The upper may define an opening configured to receive a foot of a wearer into the interior void. In addition, the upper may include a lace, which may be utilized to modify the dimensions of the interior void, thereby securing the foot within the interior void and facilitating entry and removal of the foot from the interior void.

The insole of the present disclosure may be formed of a deformable (for example, compressible) material, such as polyurethane foams, or other polymer foam materials. Accordingly, the insole may, by virtue of its compressibility, provide cushioning, and may also conform to the foot in order to provide comfort, support, and stability.

While various embodiments of the invention have been described, the description is intended to be exemplary, rather than limiting and it will be apparent to those of ordinary skill in the art that many more embodiments and implementations are possible that are within the scope of the invention. Although many possible combinations of features are shown in the accompanying figures and discussed in this detailed description, many other combinations of the disclosed features are possible. Therefore, it will be understood that any of the features shown and/or discussed in the present disclosure may be implemented together in any suitable combination. Accordingly, the invention is not to be restricted except in light of the attached claims and their equivalents. Also, various modifications and changes may be made within the scope of the attached claims.

What is claimed is:

1. An article of footwear, comprising:

a lasting board extending along a ground side surface of the article of footwear, the lasting board having a ground side surface and a foot side surface opposite the ground side surface, wherein the ground side surface of the lasting board has a peripheral area extending along a peripheral edge of the lasting board, wherein the peripheral edge of the lasting board substantially aligns with a peripheral edge of the article of footwear, and wherein the ground side surface of the lasting board has a ground-engaging area disposed inside of the peripheral area;

an upper configured to receive a foot, wherein a lower portion of the upper is secured to the peripheral area of the ground side surface of the lasting board, and wherein a top portion of the upper forms a cavity for receiving the foot; and a sole plate having a ground-engaging surface and a foot side surface opposite the ground-engaging surface, wherein the foot side surface of the sole plate is secured to the upper, wherein the sole plate has an opening exposing the ground-engaging area of the lasting board, and wherein the lasting board significantly overlaps the sole plate.

2. The article of footwear of claim 1, wherein the ground-engaging area of the ground side surface of the lasting board is bounded by the peripheral area of the ground side surface of the lasting board.

3. The article of footwear of claim 1, wherein the lasting board is disposed between an insole and a lower portion of the upper.

4. The article of footwear of claim 1, wherein the lower portion of the upper is disposed between the lasting board and the sole plate.

5. The article of footwear of claim 1, wherein the opening in the sole plate is defined by an inner peripheral edge of the sole plate, and wherein the inner peripheral edge of the sole plate is aligned with a peripheral edge of the lower portion of the upper.

6. The article of footwear of claim 1, wherein the opening in the sole plate extends along a majority of the longitudinal axis of the article of footwear.

7. The article of footwear of claim 6, wherein the inner peripheral edge of the sole plate is substantially parallel to an outer peripheral edge of the sole plate.

8. An article of footwear, comprising:

a lasting board having a ground side surface and a foot side surface opposite the ground side surface, wherein the ground side surface of the lasting board has a peripheral area extending along a peripheral edge of the lasting board and wherein the ground side surface of the lasting board has a ground-engaging area disposed inside of the peripheral area;

a sole plate having a ground-engaging surface, the ground-engaging surface extending from a forefoot region of the article of footwear to a heel region of the article of footwear, a foot side surface opposite the ground-engaging surface, an outer peripheral edge, and an inner peripheral edge defining an opening, wherein the sole plate overlies the lasting board and the opening exposes the ground-engaging area of the lasting board; and an upper configured to receive a foot, the upper having a lower portion disposed between the ground side surface of the lasting board and the foot side surface of the sole plate, and the upper having a top portion forming a cavity for receiving the foot, and wherein the inner peripheral edge of the sole plate is substantially flush with a peripheral edge of the lower portion of the upper around the entire inner peripheral edge of the sole plate.

9. The article of footwear of claim 8, wherein the foot side surface of the sole plate is secured to the upper such that a lower portion of the upper has an exposed edge, and wherein a width of the sole plate defined between the inner peripheral edge and the outer peripheral edge is substantially constant along the entire sole plate.

10. The article of footwear of claim 8, wherein the lasting board extends continuously from a forward edge of the article of footwear to a rearward edge of the article of footwear and the lasting board extends continuously from a medial edge of the article of footwear to a lateral edge of the article of footwear.

11. The article of footwear of claim 8, wherein the opening in the sole plate extends along a majority of the longitudinal axis of the article of footwear.

12. The article of footwear of claim 8, wherein the inner peripheral edge of the sole plate is substantially parallel to the outer peripheral edge of the sole plate.

13. The article of footwear of claim 8, wherein a first cleat extends from the lasting board.

14. The article of footwear of claim 13, wherein a second cleat extends from the sole plate.

15. The article of footwear of claim 13, wherein the first cleat extends from the ground-engaging area of the lasting board and the first cleat is exposed by the opening in the sole plate.

16. An article of footwear, comprising:

a lasting board extending along a ground side surface of the article of footwear, the lasting board having a ground side surface and a foot side surface opposite the ground side surface, wherein the ground side surface of the lasting board has a peripheral area extending along a peripheral edge of the lasting board, wherein the peripheral edge of the lasting board substantially aligns with a peripheral edge of the article of footwear, and wherein the ground side surface of the lasting board has a central area disposed inside of the peripheral area;

an upper configured to receive a foot, wherein a lower portion of the upper is secured to the peripheral area of the ground side surface of the lasting board, and wherein a top portion of the upper forms a cavity for receiving the foot; and a sole plate having a ground side surface and a foot side surface opposite the ground side surface, wherein the sole plate significantly overlies the peripheral area of the lasting board and has an opening exposing the central area of the lasting board such that the ground side surface of the sole plate and the central area of the ground side surface of the lasting board together form a ground-engaging surface of the article of footwear, and wherein a width of the sole plate defined between an inner peripheral edge of the sole plate and an outer peripheral edge of the sole plate is substantially constant along the entire sole plate.

17. The article of footwear of claim 16, wherein the peripheral area of the lasting board is disposed between an insole and the lower portion of the upper.

18. The article of footwear of claim 17, wherein the opening in the sole plate extends along a majority of the longitudinal axis of the article of footwear.

19. The article of footwear of claim 17, wherein a first cleat extends from the lasting board.

20. The article of footwear of claim 19, wherein a second cleat extends from the sole plate.

* * * * *